US006527134B2

(12) United States Patent
Hinkle et al.

(10) Patent No.: US 6,527,134 B2
(45) Date of Patent: Mar. 4, 2003

(54) CONTAINER MODULE FOR INTERMODAL TRANSPORTATION AND STORAGE OF DRY FLOWABLE PRODUCT

(75) Inventors: Andrew J. Hinkle, Pittsburgh, PA (US); Craig C. Menzemer, Akron, OH (US); Janet C. Swearingen, Delmont, PA (US); Charles I. Fuller, Monroeville, PA (US); David S. Bennett, Davenport, IA (US); Daniel D. Roup, Davenport, IA (US); James T. Burg, Pittsburgh, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 10/086,215

(22) Filed: Oct. 19, 2001

(65) Prior Publication Data

US 2002/0134786 A1 Sep. 26, 2002

Related U.S. Application Data

(63) Continuation of application No. 08/902,031, filed on Jul. 29, 1997, now Pat. No. 6,382,446, which is a continuation of application No. 08/602,601, filed on Feb. 16, 1996, now abandoned.

(51) Int. Cl.[7] ..... B65D 7/00
(52) U.S. Cl. ..... 220/1.5; 222/181; 222/185
(58) Field of Search ..... 220/1.5; 222/181, 222/185; 410/45

(56) References Cited

U.S. PATENT DOCUMENTS 2,056,179 A 10/1936 Fitch (List continued on next page.)

FOREIGN PATENT DOCUMENTS

| | | |
|---|---|---|
| CH | 566246 | 9/1975 |
| DE | 2142116 | 3/1973 |
| FR | 966758 | 10/1950 |
| GB | 2073146 | 10/1981 |

OTHER PUBLICATIONS

"Aluminum and Aluminum Alloys," *Kirk–Othmer Encyclopedia of Chemical Technology*, 3rd edition, John Wiley & Sons, New York, 1978, vol. 2, pp. 129–137, 172–177, and 181–185.

"Welding," *Kirk–Othmer Encyclopedia of Chemical Technology*, 3rd edition, John Wiley & Sons, New York, 1984, vol. 24, pp. 514–515.

*Primary Examiner*—Steven Pollard
(74) *Attorney, Agent, or Firm*—Maurice M. Klee; Tracey D. Beiriger

(57) ABSTRACT

A container module for intermodal transportation and temporary storage of dry flowable product includes a pressure tank supported by hanger plates welded to end frames of a support frame defining a standardized container envelope. The pressure tank has a wall with a flat top center section and short flat side sections joined by upper cylindrical intermediate sections and lower cylindrical sections below the flat side sections which blend into a plurality of intersecting, downwardly discharging hoppers. Elongated beam members extending along each side of the support frame tie the hoppers together to resist bending of the suspended tank.

18 Claims, 8 Drawing Sheets

U.S. PATENT DOCUMENTS 3,726,431 A 4/1973 Botkin
3,912,103 A 10/1975 Gerhard
3,971,491 A 7/1976 Mowatt-Larssen et al.
4,307,812 A 12/1981 Gerhard
4,345,861 A 8/1982 Aarseth
4,381,062 A 4/1983 Taquoi
4,412,626 A 11/1983 Gerhard
4,416,384 A 11/1983 Bjurling
4,574,986 A 3/1986 Baris et al.
4,593,832 A 6/1986 Gerhard
4,603,788 A 8/1986 Gerhard
4,823,989 A 4/1989 Nilsson
4,840,282 A 6/1989 Gerhard
4,902,173 A 2/1990 Hendee et al.
4,917,544 A 4/1990 Crahan et al.
5,083,673 A 1/1992 Fossey
5,248,227 A 9/1993 Hidock et al.
5,353,967 A 10/1994 Toth et al.
5,390,827 A 2/1995 Toth et al.
5,529,222 A 6/1996 Toth et al.
6,382,446 B1 * 5/2002 Hinkle et al. ..... 220/1.5

* cited by examiner

CONTAINER MODULE FOR INTERMODAL TRANSPORTATION AND STORAGE OF DRY FLOWABLE PRODUCT

CROSS REFERENCE TO RELATED APPLICATIONS

This is a continuation of U.S. application Ser. No. 08/902,031 filed on Jul. 29, 1997 now U.S. Pat. No. 6,382,446, which is a continuation of U.S. application Ser. No. 08/602,601 filed on Feb. 16, 1996 now abandoned, the contents of both of which in their entireties are hereby incorporated by reference.

BACKGROUND OF THE INVENTION

1. Field of the Invention

This invention relates to container modules for shipping by rail, truck and ship, and for temporarily storing, dry flowable product which is discharged from the container module under pressure or by gravity.

2. Background Information

Container modules for intermodal shipping are widely used and recently there has been a desire to develop intermodal containers for transport and temporary storage of dry flowable product. Such containers include an elongated tank extending horizontally in a support frame. Examples are shown in U.S. Pat. Nos. 5,390,827 and 5,353,967, incorporated herein by reference. The pressure tank has hatches along the top and loading tubes on the ends for loading and hoppers along the bottom for discharge of the dry, flowable product. While the tank is not normally pressurized during transit, it is typically pressurized to a positive atmosphere (about 14.7 psig) during discharge of its contents and that typically translates to a design pressure (1.5 factor) of about 22 psig. Several dimensional and other criteria for the container modules are set out in International Standard Organization (ISO) standard 1496-4, Series One Freight Container Specification and Testing, Part 4 Nonpressurized Containers, a standard that is well known in the art. The support frame defines an elongated rectangular, parallelpiped envelope for the container module having dimensions which have been standardized for interchangeability. Generally, the envelope is 8 feet wide, 8 feet to 9 and ½ feet high, suitably 9 feet 6 inches, and either 20 or 40 feet long. Other standardized features include nodes at each of the eight corners for stacking and lifting the modules. Additional lifting points are also specified. Maximum weights for the loaded modules have been established along with minimum volume requirements, and the tank must be able to withstand specified pressures. The slope of the hopper walls also needs to accommodate desired discharge rates. In addition, room must be provided within the envelope for the plumbing for effecting the pressure discharge of product. The container modules must also satisfy certain rigorous tests which include lifting, static loading, and pressure tests. In addition to the requirements of ISO Standard 1496-4 referred to above, there is the pressurization requirement also mentioned above plus a desired internal tank volume of 1450 or 1500 or more cubic feet, preferably 1550 or 1575 cubic feet or more. Still further, it is desired that the weight of the empty intermodular container (frame, tank and typically limited pneumatic pipes and cones that travel with the container) not exceed 10,000 pounds, or 9500 pounds, preferably 9000 or 8500 pounds. This represents a very substantial weight savings over a stainless steel and steel construction of around 15,000 pounds. Of course, cost is a concern and it is desired to produce a container at reasonable cost.

All of these competing criteria must be reconciled. For instance, maximum volume could be realized by a generally rectangular tank which filled the solid rectangular envelope. However, this would require use of high strength or heavy materials in fabricating the tank to withstand the discharge pressure, thereby adding cost and/or weight. On the other hand, a cylindrical tank could best withstand the pressure using lighter, perhaps less costly materials than the rectangular tank, but with a sacrifice in volume. As an example, a module with a generally rectangular tank is available, but it utilizes stainless steel which adds weight and is expensive. Attempts to duplicate this structure in aluminum have pointed to a serious need for improvement.

There is a need therefore for an improved container module for intermodal transportation and temporary storage of dry flowable product.

There is a more particular need for such a container module which meets volume requirements while minimizing the empty weight of the module.

There is also a need for such a container module which can meet the prescribed pressure specifications without requiring thick, heavy or exotic materials.

There is a further need for such a container module which is strong and durable, and resistant to corrosion by sea air.

There is an additional need for such a container module which has uncluttered space for the necessary discharge plumbing and can be used with a gooseneck truck.

There is yet another need for such a module which meets all of the established specifications and can pass all of the required tests.

There is an overriding need for such a container module which satisfies all the above needs and can be produced economically.

SUMMARY OF THE INVENTION

These needs and others are satisfied by the invention which is directed to a container module for intermodal transportation and storage of dry flowable product which includes an elongated support frame having a horizontally extending bottom frame and an upright end frame at each end of the bottom frame, all defining a container envelope of preset dimensions. A tank extends longitudinally along the support frame within the container envelope and has a plurality of downwardly discharging hoppers. Hanger means depending substantially vertically from the end frames engage ends of the tank above the hoppers for suspending the tank from the end frames. The tank has outwardly convex, preferably substantially spherical, end caps which are engaged by the hanger means for suspending the tank. Also, preferably, the hanger means comprises plate members secured to top cross beams and corner posts of the end frames to not only suspend the tank but also to stiffen the end frames.

As another aspect of the invention, the support frame includes corner gussets fixed to the corner posts and the top cross beams and connected to the pressure tank by channel members extending longitudinally along the pressure tank.

As an additional aspect of the invention, the support frame includes elongate members extending longitudinally along each side between the end frame corner posts and secured to each of the hoppers. These longitudinal members resist angular separation of the hoppers through bending of the tank when loaded with dry flowable product or pressurized. They also contribute to the overall structural strength of the container.

In addition, the hoppers along the bottom of the tank are longitudinally intersecting, meaning that the hoppers are spaced longitudinally closer together than their full longitudinal dimension. This increases the volume of the tank white still providing the required slope of the hopper walls for complete discharge of product. The longitudinally intersecting hoppers form girth seams which are spanned by girth plates welded to the adjoining hoppers.

The hopper at the front end of the container module is raised so that its discharge opening is above the discharge openings of the remaining hoppers. This permits the container module to be used with gooseneck trucks. The support frame is also modified at this end by a longitudinal opening which accommodates the gooseneck.

The tank is configured to provide adequate volume for the dry flowable product while withstanding the applied discharge pressure without requiring a thick wall, exotic materials or heavy bracing. To achieve this, the tank has an elongated body portion formed by a wall having a flat upper center section extending no more than about 12 inches laterally, upper curved sections extending laterally and downwardly from the upper center section, flat side sections extending downwardly from the upper curved sections no more than about 12 inches, and curved lower sections which laterally truncate the intersecting downwardly discharging hoppers extending along the bottom of the tank. Preferably, the upper curved sections and lower curved sections are cylindrical sections having radii of about 37 to 45 inches, suitably 40 to 43 or 44 inches. In the 40 foot long embodiment of the invention, there are four to six hoppers and preferably five.

In the preferred embodiment of the invention these hoppers are frusto-conical, although other configurations providing the desired slope of 37 or 40 to 45 or 50 degrees (typically 41 to 45 degrees) and a discharge opening of about 30 inches can be utilized.

All of the above features can be combined to provide a container module which is preferably made all of aluminum except for standardized nodes on each of the corners of the module which are preferably made of steel. Preferably, the tank including the hoppers is made of aluminum plate of no greater than ⅜ inch in thickness and preferably 5/16 or ¼ inch in thickness. Circumferential stiffeners can be provided on the tank body in the form of longitudinally spaced aluminum channels welded across the top flat section and extending around the upper curved sections.

The above features produce a light weight durable, corrosion resistant container module for dry flowable product which can withstand the pneumatic pressures required for product discharge with adequate margin for over-pressure, without the use of exotic materials and at a reasonable cost.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
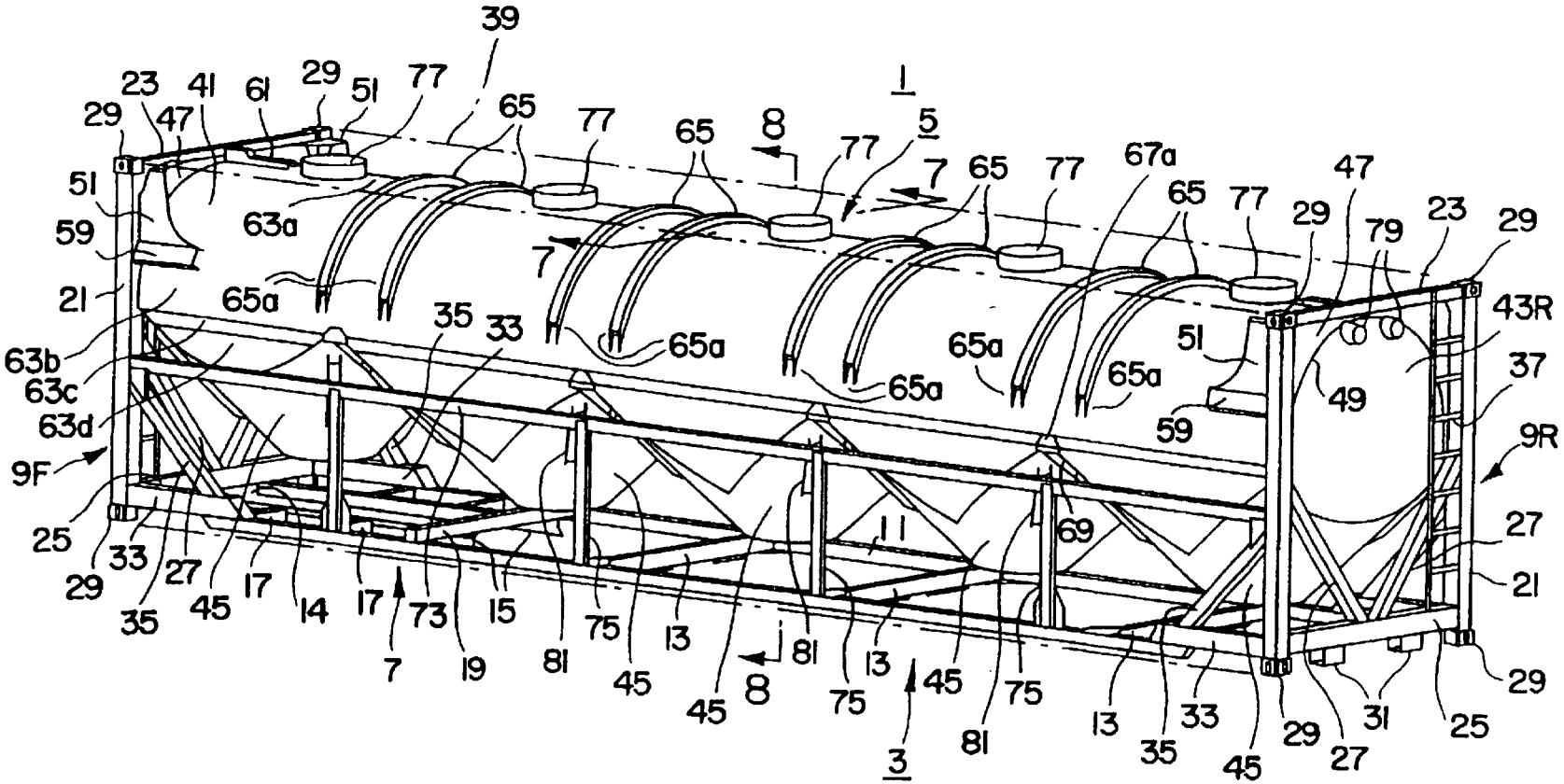
FIG. 1 is an isometric view of a container module for intermodal transportation of dry flowable product in accordance with the invention.

Referring to FIG. 1, the invention is directed to a container module 1 for intermodal transportation by truck, rail, and ship, and for the temporary storage of, dry, flowable product. While other materials could be used, the container module 1 of the invention is particularly suitable for construction essentially from aluminum. To date, container modules for dry flowable product have typically been made of steel or stainless steel. Aluminum provides an advantage in weight and corrosion resistance over steel, and in weight and cost over stainless steel. Aluminum as used herein includes aluminum alloys. The present invention overcomes the shortcomings of the prior attempts to produce a light weight, corrosion resistant essentially all aluminum container module.

The container module 1 comprises an elongated support frame 3 and a tank 5 mounted on the support frame. The elongated support frame 3 includes a horizontally extending bottom frame 7 and a pair of upright front and rear end frames 9F and 9R.

The bottom frame 7 includes two tubular longitudinal side members 11 joined by longitudinally spaced tubular cross beams 13. In order to accommodate a gooseneck truck (not shown), an opening 14 is created in the bottom frame 7 at the front end 9F by a pair of spaced apart longitudinally by extending "Z" section aluminum members 15 secured to the longitudinal side members 11 by tubular members 17 and a cross tubular member 19. The "Z" section members 15 have horizontal flanges and a vertical web, the bottom flanges pointing outwardly and the upper flanges pointing inwardly toward each other so as to be able to rest on the trailer gooseneck.

Figure 1A:
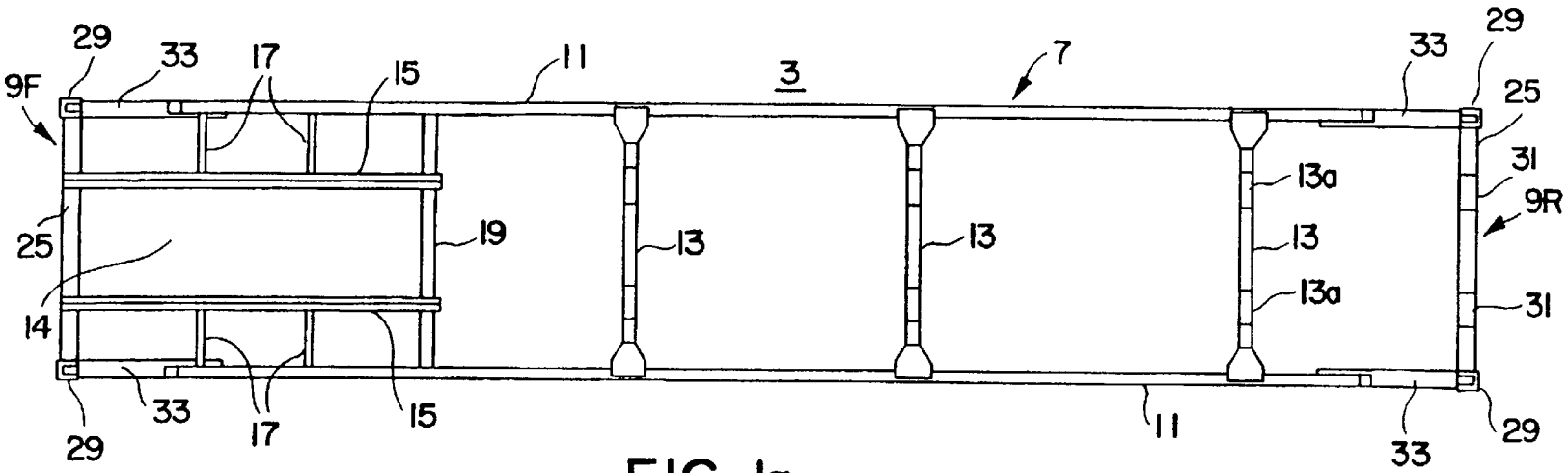
FIG. 1*a* is a bottom view of a support frame which forms part of the container module of FIG. 1.
Figure 2:
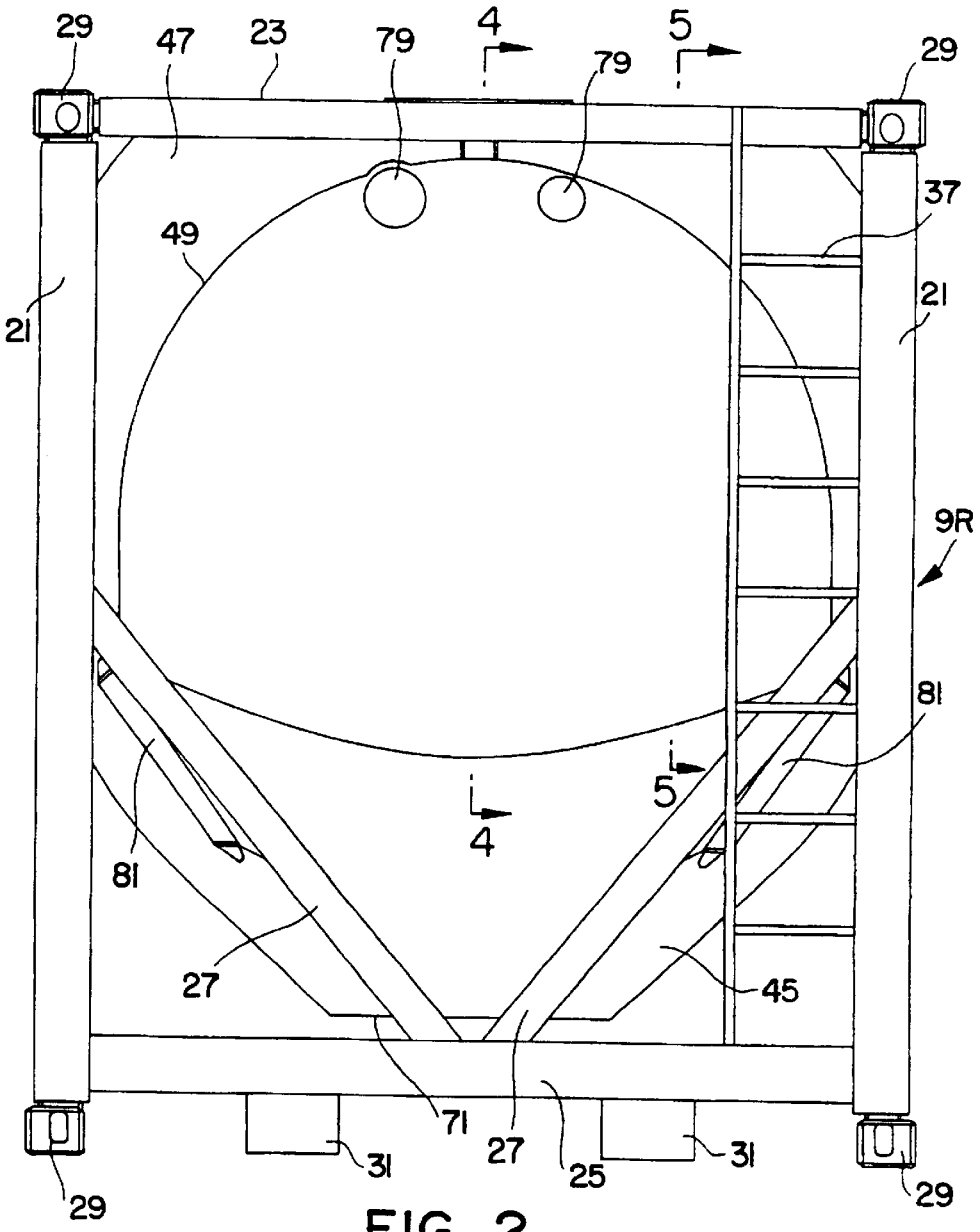
FIG. 2 is an elevation view of the right (as viewed in FIG. 1), rear end of the container module.

The end frames 9F and 9R each comprise a pair of end posts 21 joined at top and bottom by a top cross beam 23 and a bottom cross beam 25, respectively. These corner posts 21 and the top and bottom cross beams 23 and 25 are also extruded tubular members. A pair of diagonal braces 27 extend between the bottom cross beam 25 and the corner posts 21. At the four corners of each of the end frames 9R and 9F are nodes 29 for stacking and interconnecting the module 1 with other container modules. These nodes 29 are preferably made of steel and preferably are the only components of the illustrative container module 1 which are not made of aluminum. In the embodiment shown, the nodes 29 at the lower ends of the end frames 9F, 9R, raise the bottom cross beams 25 above the longitudinal members 11 of the bottom frame 7. A pair of extruded tubular blocks 31 form additional support points for the end frames 9F and 9R. Pads 13*a* (see FIG. 1*a*) under the cross beams 13 lie in a common plane with the blocks 31 to provide support for the container module on certain trucks. The corner nodes 29 can be made by providing cast steel node pieces and attaching to those cast steel pieces suitable members for engaging or attaching to the end post members 21.

The end frames 9F and 9R are connected to the bottom frame 7 by tubular end members 33 which are braced to the corner posts 4 by tubular diagonal members 35. Ladders 37 can be provided in each of the end frames 9F and 9R for access to the top of the pressure vessel 5 and there is typically a walkway, not shown, along the top. The support frame 3, with particular reference to the nodes 29, defines a rectangular, parallelpipe envelope 39 of standard dimensions. This envelope 39 is 8 feet wide, 8 to 9½ feet high and either 20 or 40 feet in length.

Figure 4:
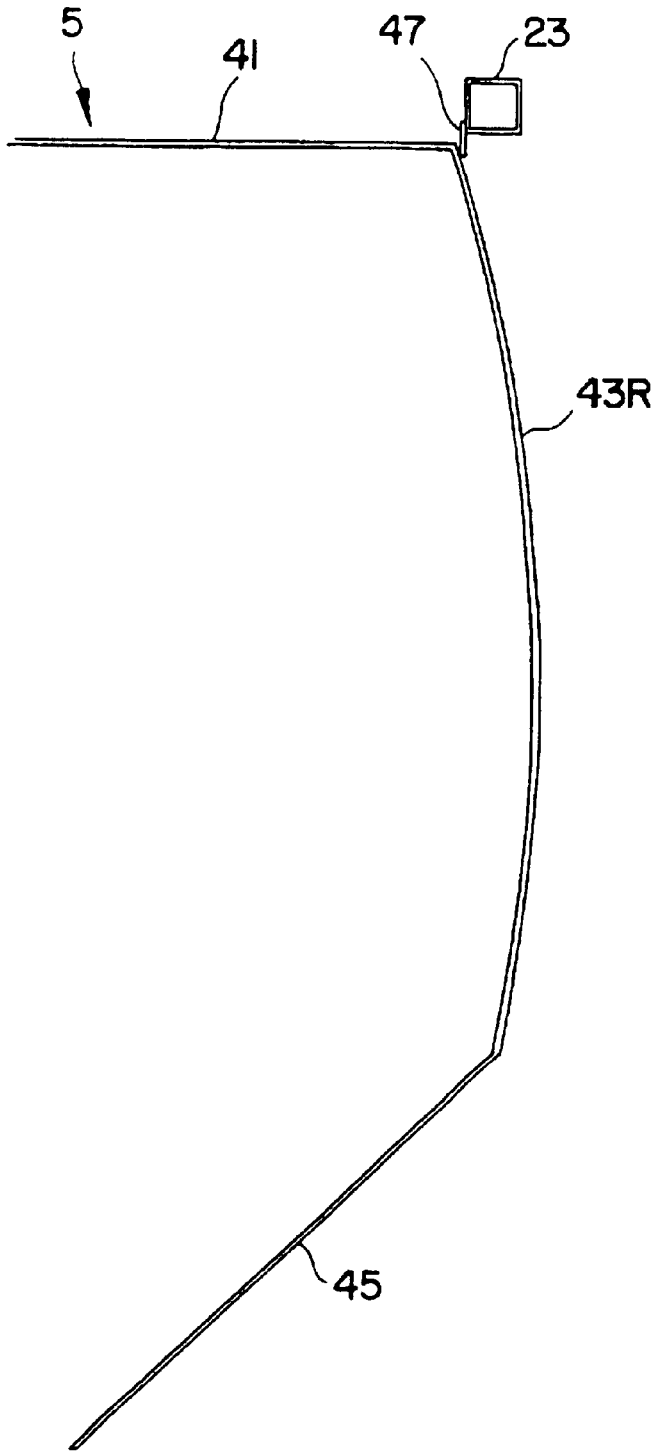
FIG. 4 is a fragmentary longitudinal section through the tank at the center line, line 4—4 in FIG. 2, showing its connection to the support frame which forms part of the container module.
Figure 5:
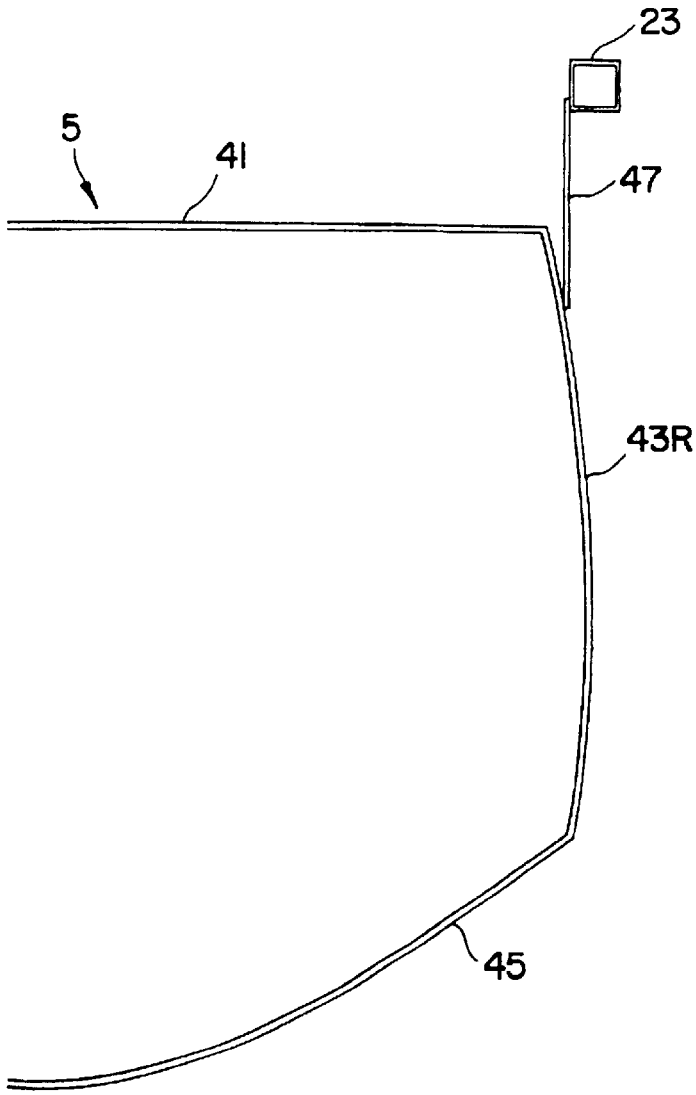
FIG. 5 is a fragmentary longitudinal section similar to FIG. 4 but taken 30 degrees off of the center line along the line 5—5 in FIG. 2.

The tank 5 has a body portion 41, a pair of front and rear end caps 43F and 43R, and a plurality of downwardly discharging hoppers 45. The end caps 43 can be curved or spherical. The radius can vary widely from about 80 to 200 inches or possibly more with a suitable radius being within about 110 to 160 or 170 inches, a suitable radius being between 125 and 135 inches. In the figures, for instance FIGS. 4 and 5, the end cap 43 is shown joined to the elongate tank wall 41 with a sharp transition therebetween which can be a weld joint. In an alternative embodiment, the transition can be provided as a radius of around 4 to 10 inches so that the end cap 43 has a major radius of about 130 inches except as it approaches the tank wall 41 where the radius is decreased to about 6 or 7 inches to blend better with the tank wall 41 in which case the weld would be moved to the left in FIG. 5. The tank 5 is supported in the support frame 3 at end regions of the tank by hanger members 47 which are plates welded to the top cross beams 23 and the corner posts 21 of each of the end frames 9F and 9R. A semi-circular or curved edge 49 in the hanger plates 47 is welded to the spherical end caps 43F and 43R. Thus, the tank 5 is suspended from the end frames 9F and 9R by the hanger plates 47 which take the weight load in tension. The hanger plates 47 being welded to both the top cross beams 23 and the corner posts 21 also serve as stiffeners for the rectangular end frames 9F and 9R.

Figure 6:
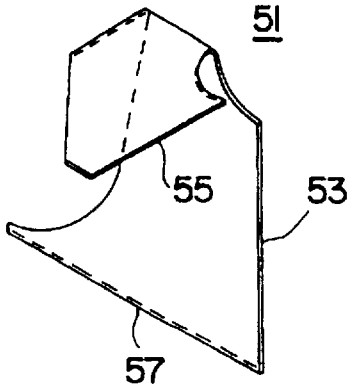
FIG. 6 is an isometric view of a comer gusset which forms part of the container module of the invention.

Additional longitudinal stability is provided by corner gussets 51. As best seen in FIG. 6, each corner gusset 51 is an L-shaped plate having a vertical planar section with a vertical edge 53 which is welded to an associated corner post 21 and a horizontal planar section with a lateral edge 55 which is welded to the associated top cross-beam 23. A bottom, elongated, longitudinal edge 57 of the vertical planar section of the corner gusset is secured to the body 41 of the pressure tank 5 which may be by a connecting member 59 in the form of a channel member which is welded to the longitudinal edge 57 and the tank 5. These corner gussets 51, along with the connecting members 59, if used, help transmit lateral forces on the pressure tank 5 into the end frames 9F and 9R. In addition, the L-shaped gussets provide longitudinal stiffness for the connection and also help to stiffen the end frames 9F and 9R. Additional longitudinal channel members 61 are welded to the top of the body 41 of the pressure tank and to the center of the top cross beams 23 to further absorb longitudinal forces on the tank.

Figure 7:
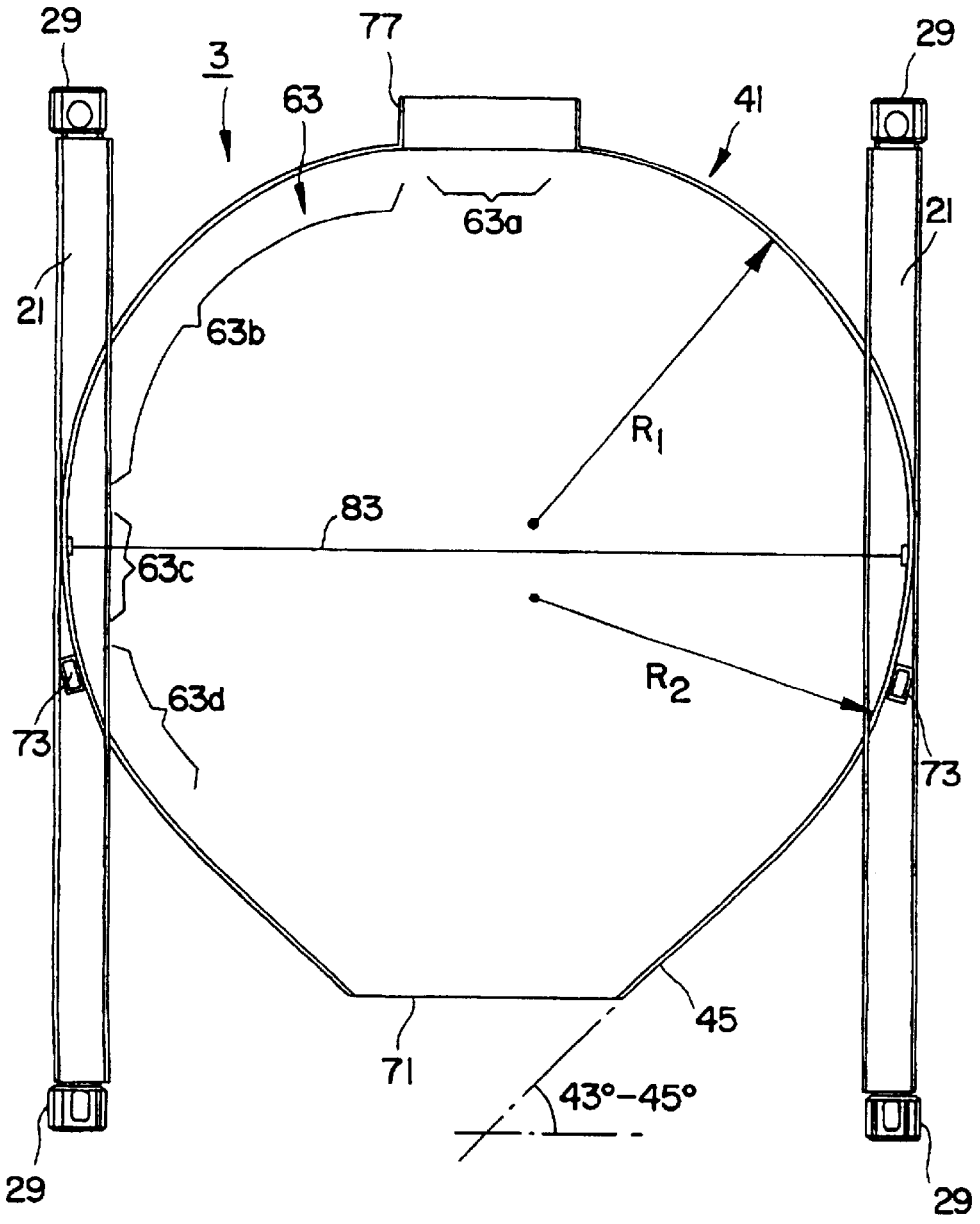
FIG. 7 is a cross-sectional view through the tank taken along the line 7—7 in FIG. 1 with some parts removed for clarity.

As best seen schematically in FIG. 7, the body 41 of the pressure tank 5 has a wall 63 with a top center section 63*a* which is flat, and upper curved sections 63*b* extending outward and downward from the top center section 63*a*. These upper curve sections 63*b* transition into vertical flat sections 63*c* which in turn blend into lower curve sections 63*d*. These lower curved sections 63*d* laterally intersect the hoppers 45. The upper curved sections 63*b* preferably are cylindrical sections of radius $R_1$, while the lower curved sections 63*d* preferably have a radius $R_2$. The radii $R_1$ and $R_2$ may be equal, but need not be. The cylindrical sections formed by the upper curve sections 63*b* and the lower sections 63*d* provide hoop strength for withstanding the pressure introduced into the tank for discharge of the dry flowable product by plumbing (not shown). While a perfectly cylindrical tank would provide the strongest cross-section for withstanding the pressure, such a configuration reduces the volume of the tank which must remain within the envelope 39 defined by the support frame 3. The top center flat section 63*a* and the side flat sections 63*c* expand the cross-section of the volume which can be contained by the tank 5 within the limits imposed by the envelope 39. These flat sections 63*a* and 63*c* are kept fairly short to reduce the deflections generated by tank pressure in these sections of the wall. Thus, the sections 63A and 63C are kept to a lateral and a vertical dimension, respectively, of not more than about 12 inches. In the exemplary embodiment of the invention, the top flat section 63A is about 6 or 7 to 10 inches, for instance 8 or 8⅜ inches wide and the vertical flat sections 63C are about 2 to 10 inches, for instance about 3 to 7, preferably around 6 inches high. In this configuration, and are roughly around 42 inches but could range from around 37 to 45 inches, preferably 40 to 43 or 44 inches. Circumferential stiffeners 65 in the form of channels are welded to the body 41 of the pressure tank 5 to increase the hoop strength. These stiffeners 65 are chamfered at the ends 65*a* to remain within the lateral dimensions of the envelope 39 and to moderate the stiffness transition at the ends of the stiffeners.

Figure 3:
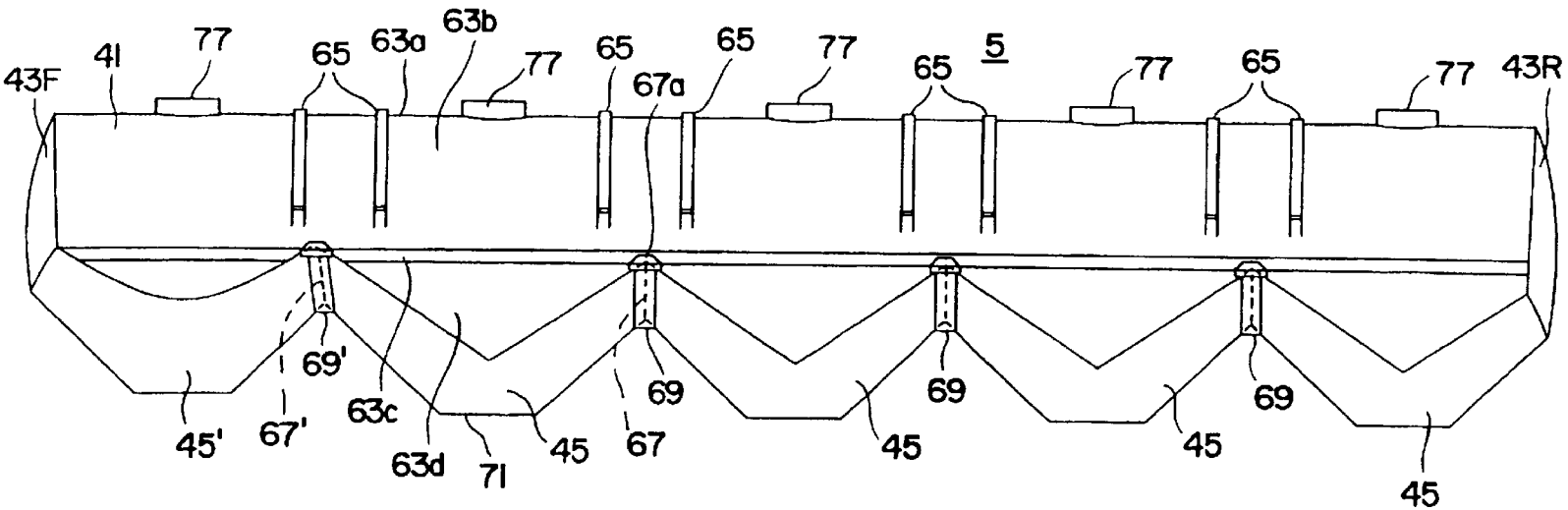
FIG. 3 is a side view of a tank which forms part of the container modules shown in FIGS. 1, 1*a* and 2.
Figure 8:
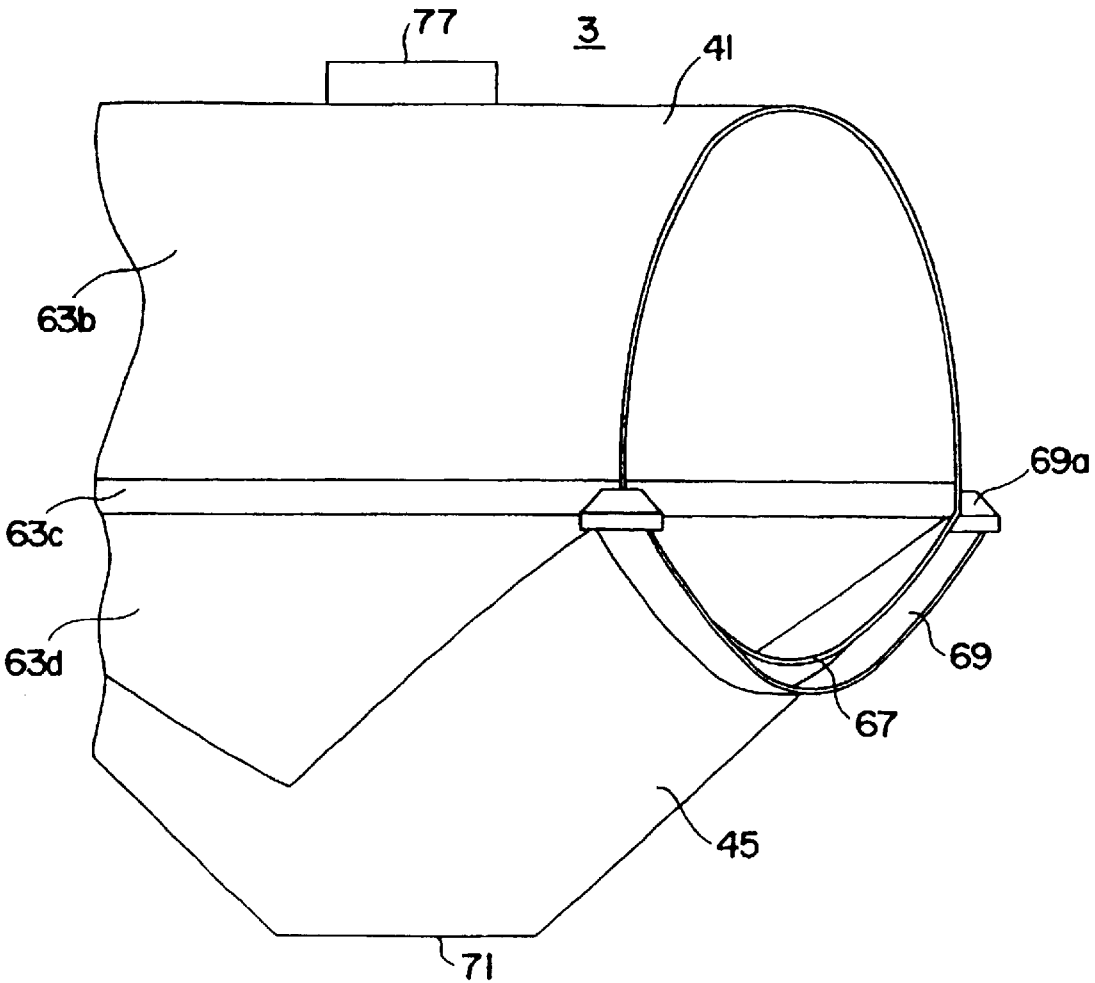
FIG. 8 is an isometric view showing a section taken through the line 8—8 of FIG. 1.

Hoppers 45 extend downward from the lower curved section 63*d* of the wall of the pressure tank 5. The hoppers 45 are spaced longitudinally so that they longitudinally intersect forming seams 67 (see FIGS. 3 and 8). In the illustrative embodiment of the invention, these hoppers are frusto-conical so that seams 67 are curved as best shown in FIG. 8. As shown there, a curved girth plate 69 spans each seam 67 and is welded to the adjoining hoppers (see FIG. 3) to provide stiffness for this joint. Cap plates 67*a* enclose the space between the girth plates 67 and the adjoining hoppers. Other shapes of hoppers can be utilized such as truncated inverted pyramid shapes which would form straight seams between intersecting hoppers. The sidewalls of the hoppers of this latter configuration could curve downward (convexly as viewed from the outside) and inward to increase the contained volume and could curve between their generally longitudinal and transverse walls. The hoppers 45 are provided with standard sized bottom discharge openings 71, typically 30 inches. A slope of 43 degrees to 45 degrees to the horizontal for each hopper sidewall is also preferably provided although hopper wall slopes of 35 to 50 degrees could be useful in some cases. The maximum diameter of the illustrative hoppers 45 at their upper ends (45° off the longitudinal axis of the tank) is 132¾ inches. The longitudinal intersection of the hoppers results from a longitudinal spacing between the centers of the hoppers of 95¾ inches. The lateral truncation of the hoppers by the lower curved sections 63*d* is a result of the tank having a maximum lateral dimension where it joins the hoppers of about 95¾ inches. These truncations of the hoppers longitudinally and laterally increase the contained volume while maintaining the desired slope of the hopper walls. The hopper 45' at the front end of the container module 1 is raised above the other hoppers to accommodate for the gooseneck thereby producing a skew in the plane of the seam 67' between the end hopper 45' and the adjacent hopper due to the difference in the intersecting diameters.

With the tank 5 suspended from each of its end regions by the hanger plates 47, the tank tends to deflect downward and outward in the center when fully loaded thereby tending to rotate the hoppers apart. In accordance with the invention, this action is resisted by elongate tubular members 73 extending longitudinally along each side of the support frame 3 between the corner posts 21 (see FIGS. 1 and 7). These elongate members 73 are welded to the sides of the hoppers 45 to thereby restrain the tendency of the hoppers to rotate apart. As can be seen in FIG. 7, these elongate members 73 engage the hoppers below the widest lateral dimension of the tank 5 so that the tank may extend to the maximum width laterally and at the same time the elongated members 73 remain within the envelope 39 formed by the support frame 3. Vertical struts 75 spaced along the longitudinal side members 11 extend to the elongate member 73 to provide vertical support for the elongate members 73 and help integrate the tank-frame construction. The elongate member 73 is shown as a rectangular tube section, which would be about 2×4 inches, inclined to lie against tank wall 63*d* as shown in FIG. 7. However, elongate member 73 could be provided as a right trapezoidal tube section so that one face is parallel to tank wall 63*d* and the other faces are horizontal (two faces) and vertical (one face). The inclined face of the right trapezoidal section could be eliminated and an unequal leg channel used such that a short horizontal leg is on top and a longer leg is on the bottom face of member 73. Providing such a horizontal bottom section face on member 73 eases attachment of vertical struts 75 to member 73. While there may be some degree of settling of the tank 5 onto these elongate members 73, the tank is essentially mostly suspended by the hangers 47. The tank 5 is loaded with dry flowable product through hatches 77 in the wall 63 along the top of the tank or through tubes 79 on the tank ends 43F and 43R. This product is discharged through the hoppers 45 under pneumatic pressure by using additional plumbing (not shown). Suspending the pressure tank 5 from the top cross beams 23 helps provide space for this plumbing and for access to the hoppers 45.

The above-described features combine to produce a container module 1 which meets the prescribed standards yet with reduced empty weight. The cross-sectional configuration of the tank 5 with a short flat top section 63*a* and flat side sections 63*c* with curved sections 63*b* between them and also between the side section 63*c* and hoppers and with 4 to 6 hoppers 45 of the types described provides the required volume and strength to withstand a pressure of 22 psi which would be 50% over a discharge pressure of 14.7 psi. In the preferred embodiment of the invention, five hoppers are utilized.

The end posts 21 and end pieces 33 and bottom cross beams 25 can be 6×6 inch "box" tubes around ½ inch thick. The cross beams 23, longitudinal bottom beam 7, braces 27 and 35, and cross members 13 can be 4×4 inch "box" tubes about ¼ inch thick. The longitudinal member 73 and vertical strut members 75 can be 2×4 inch tube about ¼ inch thick. The channel member 65 can be 2×4 inch by about ¼ inch. These box and channel members are preferably extruded and, especially the box members, are preferably in a 6000 series Aluminum Association aluminum alloy. As is known, a 6000 aluminum alloy contains mainly magnesium and silicon alloy ingredients along typically with one or more of copper, manganese or chromium also included. Alloy 6061-T6 temper is preferred. It is fairly strong and easy to work with. These relatively inexpensive heat treatable alloys (6000 alloys) can be heat treated and artificially aged to T6 temper and exhibit strength and durability and are weldable. Alloy 6061 contains about 0.8 to 1.2% Mg, 0.4 to 0.8% Si, 0.15 to 0.4% Cu, 0.04 to 0.35% Cr, balance essentially aluminum and incidental elements and impurities. The 6000 series alloys useful for extruded members for purposes of the invention consist essentially of around 0.3 to 1 or 1.5% Si, around 0.3 or 0.4 to 1.5 or 1.7% Mg; and one or more (preferably more than one) of the following: 0.1 to 1% Cu, 0.05 to 0.8 or 1% Mn, 0.05 to 0.4% Cr, 0.05 to 0.7 or 0.8% Fe as an impurity or deliberate addition; along with incidental elements and impurities, balance essentially aluminum.

Hang plate 47 can be about ⅜ inch thick aluminum alloy plate and the tank walls and hopper walls are preferably ¼ or 5/16 inch thick although a wall as thick as ⅜ inch could be used and as light as 3/16 inch could be possible. These plate members can be in a non-heat treatable alloy such as a 5000 series Aluminum Association alloy. As is known, 5000 series alloys contain magnesium as the main alloying addition (in largest amount) often along with smaller amounts of one or more of copper, manganese or chromium. The 5000 series alloys useful for the invention contain around 1 or 2 to 5% Mg, preferably about 2 or 2.2 to about 3.5 or 4% Mg, along with one or more of about 0.2 to 1 or 1.2% Mn, preferably about 0.4 to 1.1% if Mn is present; about 0.05 to about 0.35 or 0.4% Cr, preferably about 0.05 to 0.2 or 0.25% Cr if Cr is present; and on a less preferred basis about 0.05 to about 0.4 or 0.5% Cu, for instance about 0.05 to 0.2% Cu if Cu is present. Plate members for the tank (including tank walls 63, hopper walls 45 and end caps 43) and for frame parts such as hang plate 47, corner gussets 51 and girth plates 69 can be in various 5000 series alloys as just described. Suitable alloys for such include the following:

| | Max. Si | Max. Fe | Max. Cu | Mn | Mg | Cr | Max. Zr |
|---|---|---|---|---|---|---|---|
| 5454 | .25 | .4 | .1 | .5 to 1 | 2.4 to 3 | .05 to .2 | .25 |
| 5456 | .25 | .4 | .1 | .5 to 1 | 4.7 to 5.5 | .05 to .2 | .25 |
| 5083 | .4 | .4 | .1 | .4 to 1 | 4 to 4.9 | .05 to .25 | .25 |

A suitable alloy is 5454 for plate members, the alloy being in a temper resulting from strain hardening and thermally stabilizing by a low temperature treatment (H32 temper). The preferred tempers can be generally described as strain hardened and thermally stabilized or thermally softened (reduce strength some but not to full anneal or dead soft "0" condition). These tempers are known in the art as H3 and H2 type tempers. As is widely known, aluminum tempers are described in the Aluminum Association yearly publication "Aluminum standards and data". With the configuration shown, the body 41, end caps 43F and 43R and the hoppers 45 of the pressure tank 5 can all be fabricated from ¼ or 5/16 inch plate of 5454-H32 aluminum although it can be advantageous to use ⅜ inch plate for the end caps 43 and all of the tubular and channel members can be made from 6061-T6 aluminum extrusions. If necessary, hopper stiffener members 81 can be welded to the outer surfaces of the hoppers 45 as stiffeners. Also, if necessary, internal lateral stiffeners 83 preferably aligned longitudinally with the hopper openings 71 could be provided as rods or pipe-like members.

The invention to this point is described in terms of a preferred embodiment in terms of current requirements or desired features for general or broad application. Some of these features can change within the practice of the invention. For instance, for a specific application to carrying very dense or heavy material, the application could be weight limited, that is, a smaller volume tank could be used because transport weight restrictions would limit the volume of such a heavy material that could be carried. Such a tank might only be around 1400 or 1450 cubic feet and this would permit a shorter container height such as 8 foot 6 inches. In this case, the side flat members 63*c* would be extremely limited in their height or could possibly even be eliminated. Also, the angle of the hopper walls 45 to the horizontal could be reduced significantly, such as to 37 degrees.

In the event that it was desired to reduce the height of the overall container while still holding a substantial volume by deleting the provision for a gooseneck, such could be accommodated within a 9-foot high frame wherein both ends of the frame would appear like the rear end pictured in FIG. 1 but the tank would look like the front end of the tank pictured in the drawings; that is, all of the hoppers would be raised such that the tank could sit lower in the frame thereby facilitating a lower frame. As just mentioned, however, this would eliminate any provision for a gooseneck.

Still further, in the event that the discharge pressure that is required would be reduced to, say, from one atmosphere to a lower level, such would facilitate the use of thinner metal in the tank. For instance, reducing the pressure by around 33% from 14.7 psig to 10 psig would permit a corresponding reduction in metal thickness, for instance about 80 to 90% of the 33% pressure reduction (respectively around 26% or around 30% for 80 and 90% of the 33%) or possibly the entire 33% thickness reduction in the tank metal.

In another embodiment of the invention, the tank is supported by vertical plate corner gusset 51 rather than hang plate 47 although the size of the vertical portion of the gusset plate 51 may be substantially increased over that depicted in FIG. 1. Additionally, the connecting member 59 may also be made longer and heavier to accommodate the requirements of supporting the entire tank. Thus, the substantially vertical plate corner gusset member 51 would engage the end region of the tanks above the hoppers to suspend the tank from the front and rear frames 9F and 9R.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A container module for intermodal transportation and storage of dry flowable product, comprising:

a tank comprising a body portion, end caps, and a plurality of longitudinally intersecting downwardly discharging hoppers extending along a bottom of said tank, said body portion formed by a wall having a flat upper center section extending no more than about 12 inches laterally, upper curved sections extending laterally and downwardly from said upper center section, and lower curved sections laterally intersecting said discharging hoppers; and an elongated support frame which supports said tank, said elongated support frame comprising a horizontally extending bottom frame and upright end frames at each end of said bottom frame, the corner extremities of said elongated support frame defining a container envelope of preset dimensions;

wherein:

(i) said wall, said end caps, and said discharging hoppers are made of a material comprising aluminum plate having a thickness no greater than about ⅜ inch;

(ii) said tank can withstand a pressure of at least about 22 psig; and (iii) said elongated support frame comprises elongate members extending along each side between said end frames and secured to each hopper, said elongate members engaging said hoppers below the widest lateral dimension of said tank and tying said hoppers together to resist bending.

2. The container module of claim 1 wherein said wall, said end caps and said discharging hoppers are made of a material comprising aluminum plate having a thickness of about ¼ inch.

3. The container module of claim 1 wherein said support frame is substantially made of a material comprising aluminum.

4. The container module of claim 3 wherein said end frames comprise non-aluminum top and bottom corner nodes.

5. The container module of claim 1 wherein said tank has a volume capacity of at least about 1550 cubic feet.

6. The container module of claim 5 wherein said tank has a volume capacity of approximately 1575 cubic feet.

7. The container module of claim 5 wherein said tank has a volume capacity of approximately 1650 cubic feet.

8. The container module of claim 1 wherein said tank and said support frame have a weight of no greater than about 10,000 pounds.

9. The container module of claim 1 wherein said tank has a volume capacity of at least 1500 cubic feet and the tank and support frame together weigh less than about 10,000 pounds.

10. The container module of claim 1 wherein said upper curved sections and lower curved sections of said wall have radii of about 37 to 45 inches.

11. The container module of claim 1 wherein said discharging hoppers are frusto-conical hoppers.

12. The container module of claim 1 wherein said discharging hoppers have discharge openings about 30 inches across and side walls converging toward said openings at an angle of about 38 degrees to 45 degrees to horizontal.

13. The container module of claim 1 wherein a discharging hopper at one end of the tank is raised above the other discharging hoppers.

14. The container module of claim 1 wherein said longitudinally intersecting discharging hoppers define girth seams at their intersections and said module comprises girth plates spanning said girth seams and affixed to adjoining hoppers.

15. The container module of claim 1 wherein said tank is about 40 feet in length, and wherein said longitudinally intersecting hoppers comprise four to six longitudinally intersecting hoppers.

16. The container module of claim 15 wherein said longitudinally intersecting hoppers comprise five longitudinally intersecting hoppers.

17. The container module of claim 1 wherein said end caps are convex caps intersected by end hoppers.

18. The container module of claim 1 wherein said end caps are substantially spherical.

* * * * *